US005823435A

United States Patent [19]

Morgan et al.

[11] Patent Number: 5,823,435

[45] Date of Patent: Oct. 20, 1998

[54] ROTATING NOZZLE

[75] Inventors: Sean Morgan; Stuart Morgan, both of Mentone, Australia

[73] Assignee: Spray Nozzle Engineering Pty. Limited, Cheltenham, Australia

[21] Appl. No.: 716,205

[22] PCT Filed: Mar. 17, 1995

[86] PCT No.: PCT/AU95/00149

§ 371 Date: Oct. 10, 1996

§ 102(e) Date: Oct. 10, 1996

[87] PCT Pub. No.: WO95/25599

PCT Pub. Date: Sep. 28, 1995

[30] Foreign Application Priority Data

Mar. 18, 1994 [AU] Australia ..... PM4523/94

[51] Int. Cl.[6] ..... B05B 15/02

[52] U.S. Cl. ..... 239/107; 239/116; 239/383; 239/456; 239/571

[58] Field of Search ..... 239/106–9, 222.17, 239/280–3, 451–4, 456, 459, 515, 114–116, 123, 225.1, 570, 571, 1

[56] References Cited

U.S. PATENT DOCUMENTS

| | | | |
|---|---|---|---|
| 3,685,735 | 8/1972 | Foster | 239/109 |
| 3,974,853 | 8/1976 | Bentley | 137/503 |
| 4,261,515 | 4/1981 | Rosenberg et al. | 239/222.17 |
| 4,832,264 | 5/1989 | Rosenberg | 239/222.17 |
| 5,033,676 | 7/1991 | King et al. | 239/107 |
| 5,193,746 | 3/1993 | Iwamura et al. | 239/109 |
| 5,215,254 | 6/1993 | Haruch | 239/107 |
| 5,232,156 | 8/1993 | Csordas et al. | 239/117 |

*Primary Examiner*—Andres Kashnikow
*Assistant Examiner*—Lisa Ann Douglas
*Attorney, Agent, or Firm*—Edwin D. Schindler

[57] ABSTRACT

A rotating spray nozzle for use in cleaning containers having a spray head on a shaft, an element for passing liquid both to the exterior of the spray head to cause rotation thereof and for the delivery of liquid in annular streams, liquid passing to the spray head through the shaft and having an hydraulic bearing therefor, the liquid after passing from the spray head occupying which would be a void as far as washing is concerned. The spray head is also moveable axially relative to the shaft, a spring holding the spray head away from the bottom of the shaft when there is no pressure passing therethrough, the pressure of the liquid moving the spray head to the bottom of the shaft, the arrangement providing a manner whereby foreign material can be removed from between the spray head and the shaft as, by reducing the pressure, the space between these can be increased, thus permitting ready flushing of the foreign material. Flushing can be facilitated by liquid passing between the shaft and the spray head and liquid can be disseminated beneath the spray head by a liquid stream which is at an angle to the axis of the nozzle.

12 Claims, 3 Drawing Sheets

ROTATING NOZZLE

This invention relates to a rotating nozzle and in particular to a nozzle which is adapted, whilst rotating, to cause sprays of liquid to move outwardly to effect a cleaning operation.

Such nozzles are used, for example, in cleaning containers, such as say road tankers where the nozzle can be selectively inserted into the tanker, barrels and the like, where, again, the nozzle can be inserted through the bung aperture, and food equipment, which may be mixers, extruders or other devices. Alternatively, in a number of applications, the nozzles, and the associated liquid lines can be fixed to the article to be cleaned.

Such nozzles have been known and normally include a rotor which is adapted to distribute liquid applied thereto under pressure and which is also arranged as to be rotated by the liquid impinging thereon.

These nozzles have been satisfactory, and indeed are probably the most satisfactory way of cleaning the types of articles to which they are applied, other than physical cleaning by a person, although this can be difficult if not impossible in some containers, but they do suffer from drawbacks.

The first of these is that, generally, they are reliant on the liquid being extremely clean and free from any particles.

It will be appreciated that generally they have a rotor shaft or pintle which extends through the centre of the nozzle rotor and the liquid can normally pass both between the rotor and the shaft, to provide a bearing, and may well also provide a hydraulic bearing at the lower end of the rotor and externally thereof, the external liquid acting both to drive the rotor by impinging thereon and being thrown away therefrom, by the actions being controlled by the shape of the rotor.

If there are any solid materials which pass between the shaft and the rotor these can destroy the liquid bearing formed there between and can prevent the rotor from rotating relative to the shaft.

Normally the input liquid passes through a filter to avoid any such material passing but this is not absolutely reliable.

A first object of the invention is to provide a nozzle of this general type in which such problems can be substantially or completely overcome.

Also, with nozzles of this type we find that whilst we get a very good spray distribution around the periphery of the nozzle and upwardly relative to the nozzle that there tends to be a void in the spray directly beneath the nozzle.

A second object of the invention is to overcome or minimise this disadvantage.

In its broadest aspect we provide a rotating nozzle of the type generally hereinbefore described in which the rotor shaft is tapered and the nozzle is provided with a bore which is similarly tapered, a head being provided on the lower end of the rotor shaft which provides an annular abutment surface and a counter bore in the rotor, a spring located between the abutment and the top of the counter bore, the arrangement being such that when the nozzle is used under pressure the rotor is moved against the spring to adopt a position which is similar to conventional rotors but when the pressure is released the spring causes movement of the rotor against the flow to effectively enlarge the annular space between the rotor and the shaft to permit any solid material which is passed there between to be flushed therefrom.

In the second aspect of the invention we provide a device similar to that described here in above wherein under the pressurised application liquid can be passed around the head of the shaft and be constrained to move initially generally downwardly to provide a spray in the area which would normally be void.

In order that the invention may be more readily understood we shall describe one particular form of spray nozzle made in accordance with the accompanying drawings, in which.

Figure 1:
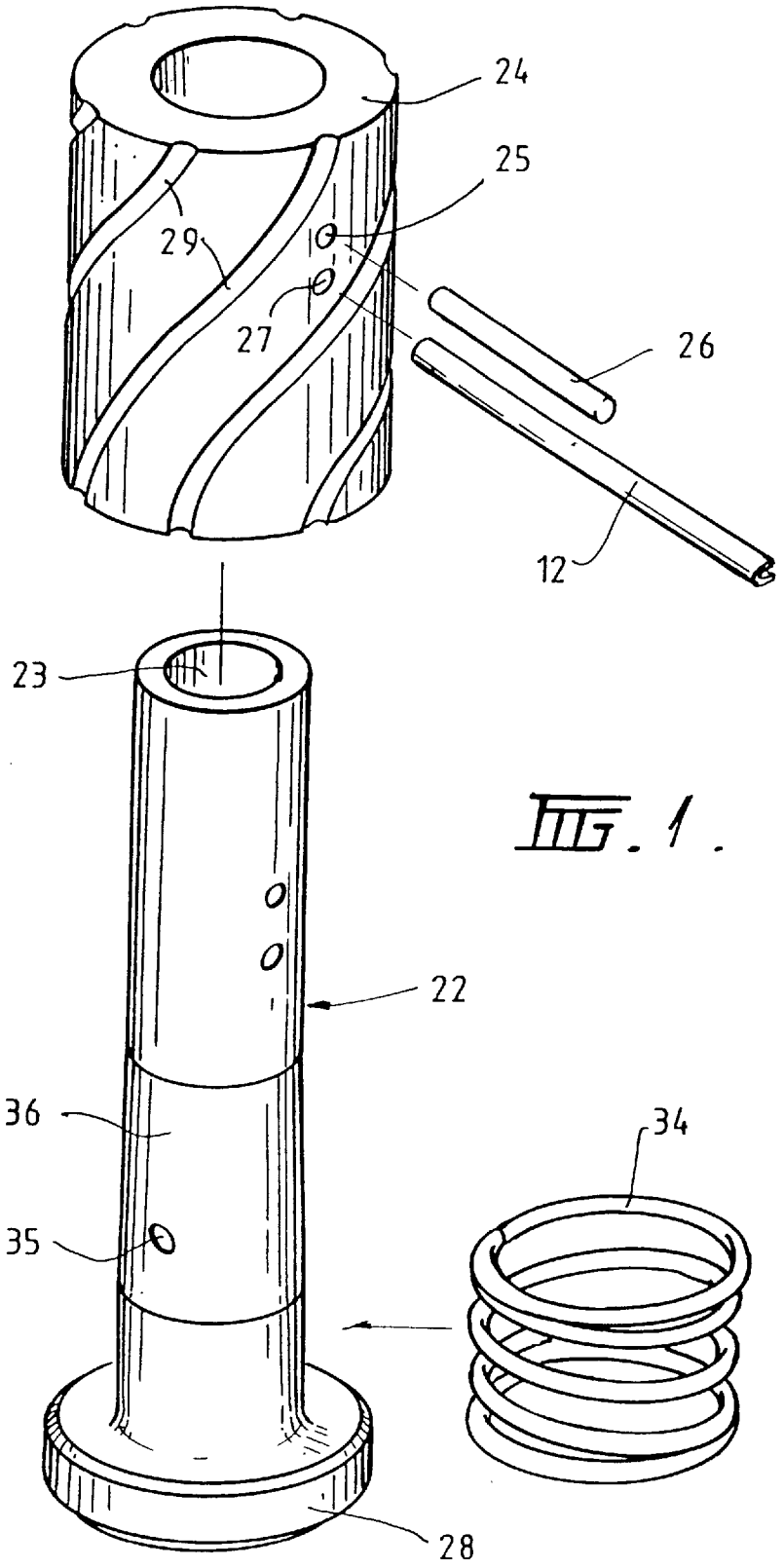
FIG. 1 shows a side elevational, perspective view of the nozzle.
Figure 2:
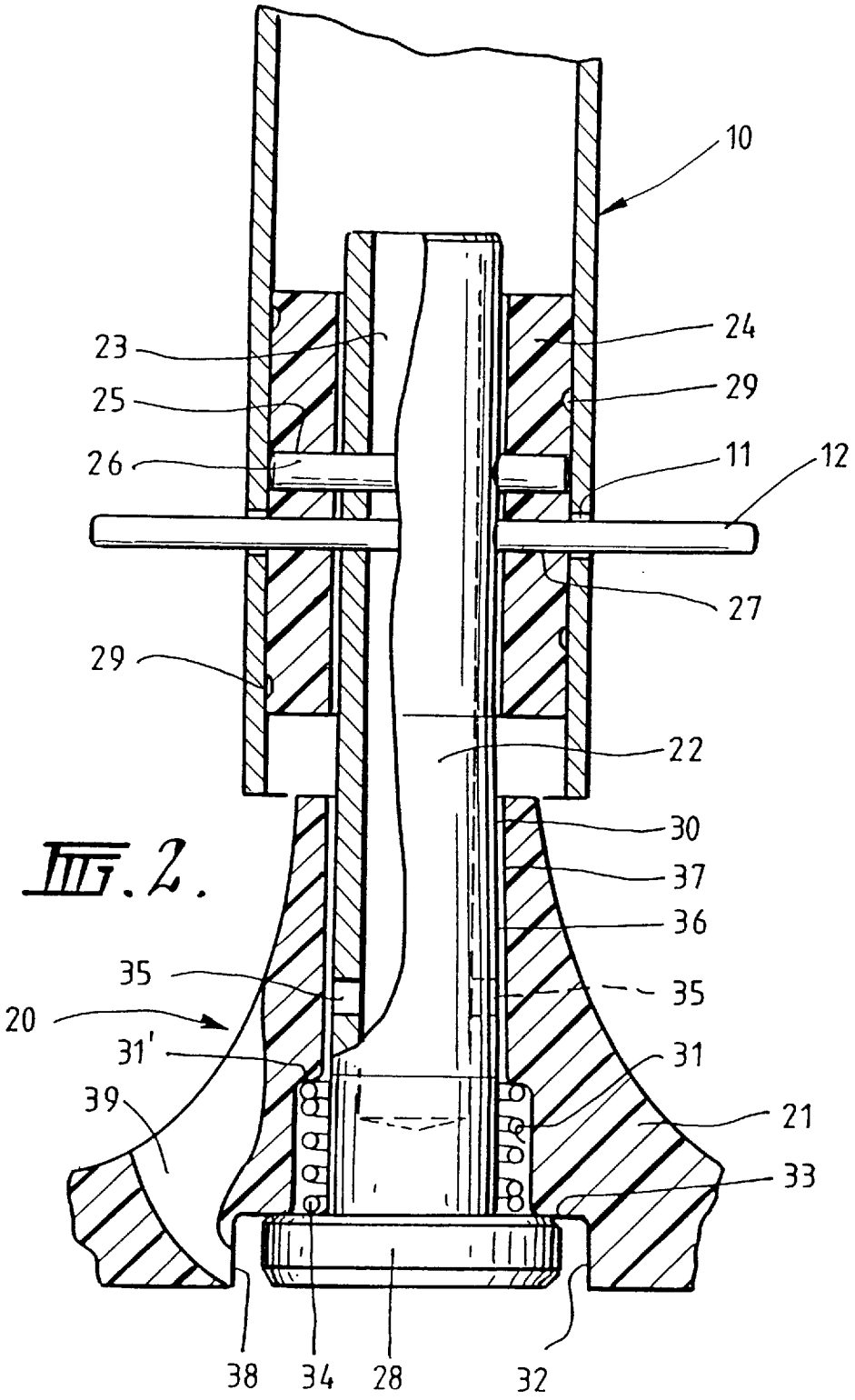
FIG. 2 shows a vertical section through the nozzle, with the spray head being in its operative position.
Figure 3:
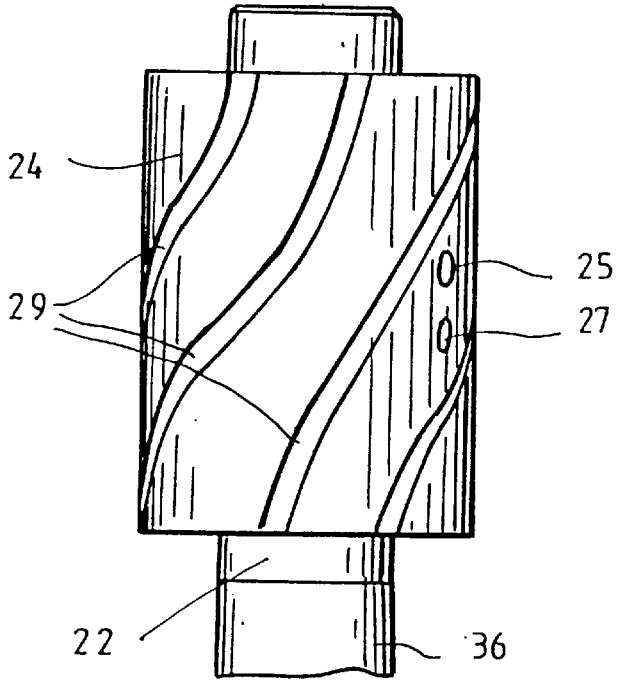
FIG. 3 shows an enlarged view of the spider and the interconnection of the spray head.
Figure 4:
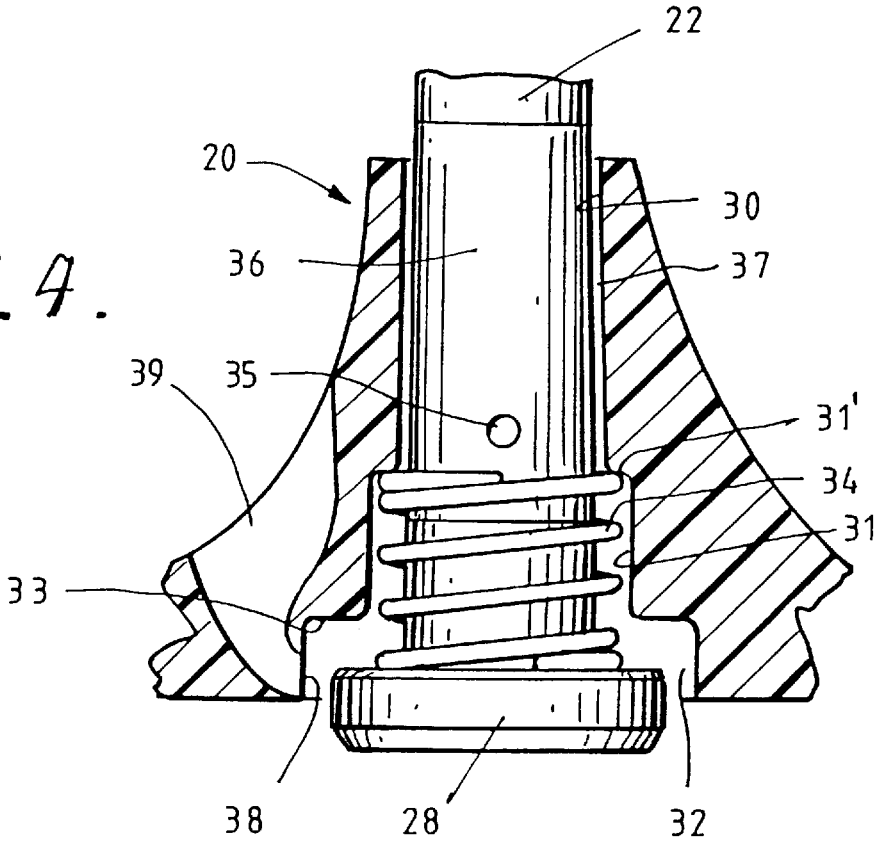
FIG. 4 shows an enlarged view of the spray head when in its first, rest, position where the spacing between the tapers on the shaft and the spray head is at a maximum.

The spray nozzle 10 has a body 10 which is adapted to be connected to a high pressure line in any required way and a head assembly 20 which has a spray head 21 at the lower end thereof.

Part of the head assembly 20 is located internally of the body 10 and comprises a rotor shaft 22, which is attached to the body 10 and which has a central aperture 23 therethrough and which is tapered inwardly 36 on the lower part of its outer surface.

The upper end of the rotor shaft is connected to a spider or the like 24. This spider may be of a synthetic plastics material and has an outer diameter to fit relatively closely in the body 10 which ensures that the head assembly is held centrally relative to the body.

The inner diameter of the spider is less than the outer diameter of the rotor shaft, thereby permitting an annular stream of liquid to pass downwardly between the spider and the shaft and then between the shaft and the rotor head and the body to assist liquid purge of the bearing surface formed therebetween.

The spider 24 has helical grooves 29 thereabout, which grooves permit liquid to pass between the body 10 and the spider and by which liquid is so directed that when it strikes the spray head 21, as will be described hereafter, it provides a turning force on the spray head. The number, size and angular orientation of these grooves can be varied, depending on the amount of liquid to be passed and the required speed of rotation of the spray head.

The spider has an aperture 25 passing therethrough which co-operates with a companion aperture in the rotor shaft 22 and a pin 26 which passes therethrough to lock the spider to the rotor shaft so that the spider is fixed relative to the rotor shaft.

There is a further aperture 27 through the spider and the rotor shaft which correspond with apertures 11 in the wall of the body 10. A pin 12, which may be a generally U-shaped member made of a spring steel has one arm which can pass through these apertures retaining the head assembly 20 fixed relative to the body 10.

At its lower end, the rotor shaft 22 is provided with a head element 28.

The spray head 21 has a central bore 30 which has a first counter bore portion 31 adjacent its lower end and a second counter bore portion 32 separated from the first counter bore portion by a shoulder 33. A compression spring 34 acts between a shoulder 33 in the spray head between the major part of this and the first counter bore 31 and the rear of the head element 28. Under "no-pressure" situations, as illustrated in FIG. 1, the head element 28 extends below the spray head 21.

The spray head can thus be moved axially from this position against the tension of the spring 34 downwardly until the top of the head is contacted by the shoulder 33 in the spray head. Thus the spray head can assume two positions, a lower position at which the annulus formed at the base of the larger diameter counter bore strikes the top of the head and the other in which the body of the spray head strikes the underside of the spider in the tube in which the shaft is mounted.

In the lower part of the rotor shaft 22 there are a pair of diametrically opposed apertures 35 which permit the movement of liquid from the centre of the shaft to the space between the shaft and the bore of the spray head.

When the device is operating under pressure, there will be liquid passing through the centre of the rotor shaft 22 and through the apertures 35, liquid passing through the grooves 29 about the spider 24 in streams dictated by the formation of the grooves and liquid passing between the spider and the shaft and the rotor head and the shaft which helps maintain the hydraulic bearing and purge any foreign material.

The spray head, which may be made of nylon or any other material is provided with a central aperture which is tapered at 37 similarly to the shaft and is moveable between two positions.

The actual external shape of the spray head is not part of the invention, as such and can be a spray head as known in the art. The main characteristic of the spray head is that when liquid is directed onto its upper surface, in a sheet or sheets and/or stream or streams, the liquid causes the spray head to rotate and, at the same time, the excess energy of the liquid causes it to be sprayed outwardly from the head in sheets or streams, which are effectively annular because of the rotation, the sheets or streams covering the whole of the area to be cleaned.

Under normal circumstances the spring 34 will act against the spray head 21 and cause it to move to the second of these positions, the one illustrated in FIG. 1.

At this position the spacing between the bore of the spray head and the shaft 22 is maximised.

When pressurized liquid is applied to the shaft, this will pass into the hollow bore 23 of the shaft and can pass therefrom by way of the liquid ports 35 into the space between the spray head 21 and the shaft 22.

The liquid passing through the grooves 29 on the spider 24 will strike against the upper formation of the spray head and will provide a downward pressure on the spray head which will cause the spring 34 to be compressed and the spray head to move to its lower position as well as to cause the spray head to rotate and a stream of liquid to flow outwardly therefrom.

Thus whilst the liquid is under pressure, the spray head is moved downwardly until it contacts the underside of the head of the shaft. As, during operation, there can be a variation in the fluid pressure, in fact, the position of the spray head is likely to fluctuate relative to the shaft, the effect of which is as will be explained hereinafter.

An hydraulic bearing is formed between the shaft 22 and the spray head and between the underside of the shaft's head and the spray head and this bearing facilitates the rotation of the spray head. As mentioned above, the liquid striking the outer portion of the spray head will cause the spray head to rotate. At the same time, the liquid will be deflected upwardly, outwardly and downwardly by the formation of the spray head.

As described earlier herein, there will normally be a void cone directly beneath the rotor. The actual form of the spray head which will operate in this way, as mentioned above, is known.

However, in this arrangement the liquid which is providing the hydraulic bearing will pass between the head element 28 at the lower end of the shaft and the adjacent portion of the counter bore 32 on the spray head. It will be appreciated that this liquid will extend downwardly past the head element.

We provide, extending through the rotor head and terminating inwardly directed adjacent the lower end thereof an aperture 38, which may be rectangular in form and which is in connection with the upper side of the rotor head and can thus provide a stream of liquid directed towards the axis of the shaft. The liquid passing through this aperture, strikes the liquid which has passed between the rotor head and the shaft and causes this to be disbursed into a conical flow, thus occupying the void angle which would otherwise have occurred and ensuring full washing of the area surrounding the nozzle.

If required, together with this, the adjacent portion of the counter bore 32 could be flared so that there will be a distribution of this liquid effectively through the whole of the otherwise void angle.

Thus the nozzle achieves the second aspect of the invention and causes the nozzle to be more efficient than previously used nozzles of this type.

If there should be any solid matter which passes between the shaft and the spray head, as by passing through the holes in the shaft, which solid matter prevents or restricts rotation of the spray head then, if the pressure of the liquid is reduced, the spring will cause the spray head to move upwardly on the shaft and, because of the effect of the tapered portions 36, 37 this will effectively open the spacing between the shaft and the spray head, and any solid material will be purged by liquid passing through the ports 35 and liquid stream which passes between the shaft and the rotor had, as previously described. The fact that this liquid is under some pressure means that there is a positive action which tends to break-up any build up.

At the same time the head of the shaft is not being held into close contact with the shoulder of the counter bore so that any solid material is readily flushed therepast.

Once the flushing operation is completed pressure can be reapplied, the spray head is again moved against the spring and washing can continue.

In fact, the nozzle of the invention will, in most cases, prevent the build up of foreign material. As mentioned earlier, during normal operation, there will be movement of the spray head relative to the shaft caused by pressure variations in the liquid line, so there can be a continuing, limited degree of purging, during normal operation and this will often prevent any build up of foreign material.

In this way the first aspect of the invention is achieved.

It will be appreciated with articles of this type the rotating portion and the fixed portion are usually held together by a circlip or in some other mechanical way and normally if there is clogging it would be necessary to strip the whole assembly, clean the solid material therefrom and refit the assembly. This can be a time consuming and tedious job.

Using the arrangement of the present invention this is not required and the cleaning can be done rapidly simply by reducing the pressure, it could be done automatically by sensing if the rotor is slowing or has stopped and, as mentioned above is effectively done every time the nozzle is being used so that any solid matter which has been received within the nozzle tends to be flushed even before it has caused problems.

It will be appreciated whilst we have described one particular form of the invention, and the benefits that can be achieved therefrom, it would be possible to make various alterations in the nozzle of the invention without departing from the spirit and scope thereof.

We claim:

1. A rotating spray nozzle, comprising:

a rotor shaft having a lower end;

a spray head rotatably mounted on said rotor shaft;

a head element being provided on the lower end of said rotor shaft, said head element providing an annular abutment surface and a counter bore in said spray head;

a spring located between the annular abutment and the top of the counter bore to which pressure is capable of being increased or decreased, said spring including means for flushing any solid material from between said spray head and said rotor shaft, so that when said spring is released and the pressure is decreased, said spring causes movement of said spray head against a liquid flow to form an annular space between said spray head and said rotor shaft for permitting any solid material located therebetween to be flushed therefrom.

2. A nozzle as claimed in claim 1 wherein the bore of the rotor shaft and the spray head have complementary tapered portions which, when there is relative movement between the rotor shaft and the spray head, provide variable spacing therebetween these.

3. A nozzle as claimed in claim 2 wherein the tapers on the shaft and the bore of the spray head are wider at the lower end of the nozzle and are of a smaller diameter towards the upper end so that when the nozzle is not pressurised the spacing between the shaft and the spray head is maximised.

4. A nozzle as claimed in claim 1 wherein under the pressurized application liquid can pass around the head element of the shaft and be constrained to move initially generally downwardly to provide a spray in the area beneath the nozzle.

5. A nozzle as claimed in claim 4 wherein there is a stream of liquid that flows through the head element to a position adjacent the lower end thereof, which stream is at an angle to the axis of the shaft and reacts with the liquid moving generally downwardly and causes it to extend over the void cone.

6. A nozzle as claimed in claim 1 wherein the shaft has a spider thereabout which acts both to centralize the spray head relative to the shaft and to direct liquid onto the upper surface of the spray head in such a manner as to ensure the required rotation of the spray head.

7. A nozzle as claimed in claim 6 wherein the spider has grooves about the surface thereof to control the liquid flow therethrough and to provide the required liquid flow to effect cleaning.

8. A nozzle as claimed in claim 6 wherein the spider is fixed relative to the shaft.

9. A nozzle as claimed in claim 8 wherein there is an annular space between the spider and the shaft through which an annular flow of liquid can pass, which flow can pass between the shaft and the rotor head to act to maintain a hydraulic bearing therebetween and to purge any foreign material which builds up on the shaft.

10. A nozzle as claimed in claim 9 wherein there is a liquid flow passing through the rotor head at an angle to the axis thereof and which strikes the liquid which passes between the shaft and the rotor head to distribute this liquid into the void space beneath the nozzle.

11. A nozzle as claimed in claim 10 wherein in this position, the upper surface of the spray head contacts the underside of the spider.

12. A nozzle as claimed in claim 1 wherein when there is no liquid pressure the spring moves the spray head until it reaches a stop and the tapered portions are so arranged that there is maximum spacing between the shaft and the spray head.

* * * * *